US008007250B2

(12) United States Patent
Lim et al.

(10) Patent No.: US 8,007,250 B2
(45) Date of Patent: Aug. 30, 2011

(54) COMPRESSOR

(75) Inventors: Kweonsoo Lim, Daejeon-si (KR); Mingyu Kim, Daejeon-si (KR); Duckbin Yoon, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 793 days.

(21) Appl. No.: 12/084,211

(22) PCT Filed: Aug. 11, 2006

(86) PCT No.: PCT/KR2006/003142

§ 371 (c)(1),
(2), (4) Date: Apr. 28, 2008

(87) PCT Pub. No.: WO2007/074960

PCT Pub. Date: Jul. 5, 2007

(65) Prior Publication Data

US 2009/0136364 A1 May 28, 2009

(30) Foreign Application Priority Data

Dec. 26, 2005 (KR) ..... 10-2005-0129708

(51) Int. Cl.
*F04B 27/08* (2006.01)
*F04B 53/10* (2006.01)
*F01B 3/00* (2006.01)

(52) U.S. Cl. ..... 417/269; 417/532; 92/71

(58) Field of Classification Search ..... 417/269, 417/532; 92/71
See application file for complete search history.

(56) References Cited

U.S. PATENT DOCUMENTS

| | | | | |
|---|---|---|---|---|
| 4,431,378 | A * | 2/1984 | Hattori et al. | 417/269 |
| 5,009,574 | A * | 4/1991 | Ikeda et al. | 417/269 |
| 5,385,451 | A * | 1/1995 | Fujii et al. | 417/269 |
| 5,401,144 | A * | 3/1995 | Fujii et al. | 417/269 |
| 7,841,840 | B2 * | 11/2010 | Sato et al. | 417/269 |
| 2003/0095873 | A1 | 5/2003 | Tarutani et al. | |
| 2007/0031264 | A1 * | 2/2007 | Ishikawa et al. | 417/269 |

FOREIGN PATENT DOCUMENTS

| | | | |
|---|---|---|---|
| JP | 409250447 | A * | 9/1997 |
| WO | WO 2004/094827 | A1 | 11/2004 |

* cited by examiner

*Primary Examiner* — Charles Freay
(74) *Attorney, Agent, or Firm* — Fulbright & Jaworski L.L.P

(57) ABSTRACT

The present invention relates to a compressor, which includes a main refrigerant supply channel for supplying refrigerant by passing through the inside of a driving shaft and an auxiliary refrigerant supply channel for supplying refrigerant by passing through a suction chamber of front and rear housings and a slot of the driving shaft after passing through cylinder blocks in order to supply the refrigerant inhaled into a swash plate chamber to cylinder bores, thereby enhancing performance and lubricating ability of a driving shaft seal area since the refrigerant of the swash plate chamber can be used effectively.

5 Claims, 6 Drawing Sheets

[Fig. 1]
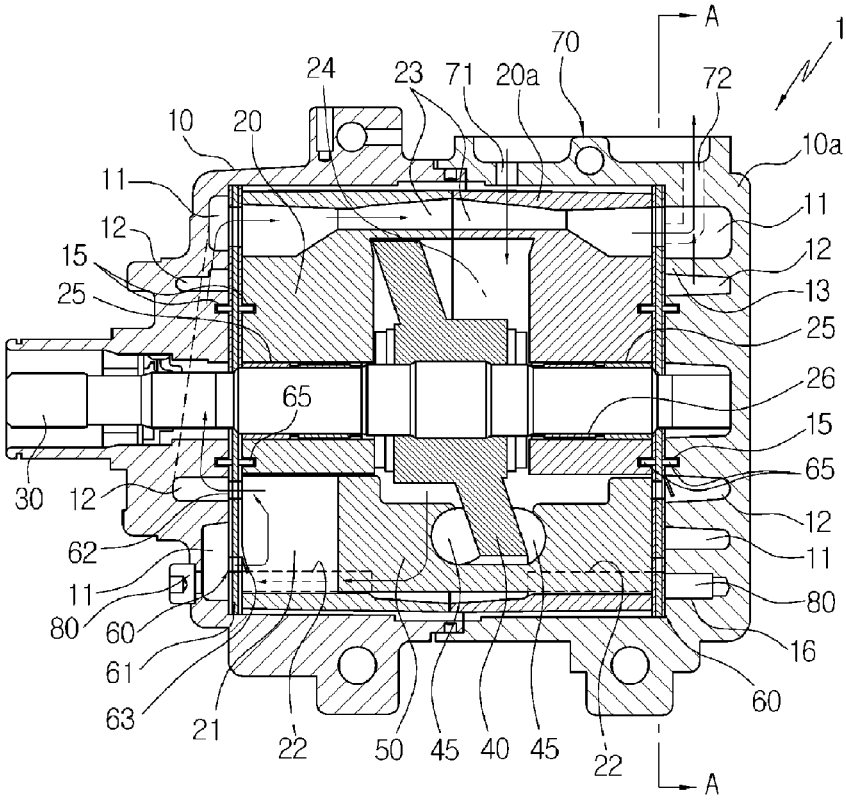
[Fig. 2]
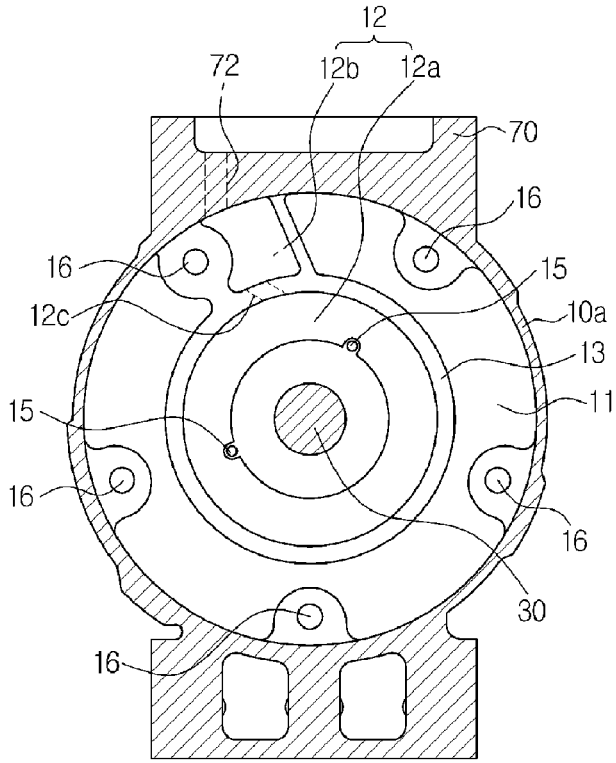

[Fig. 3]
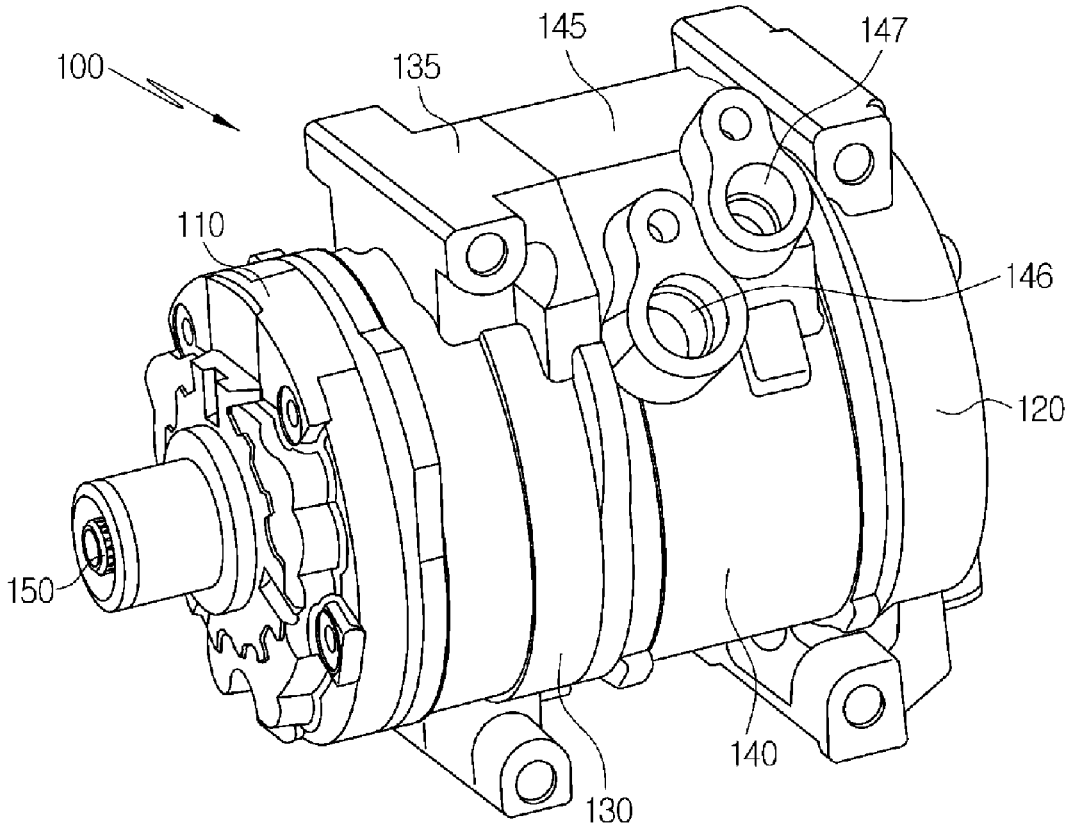

[Fig. 4]
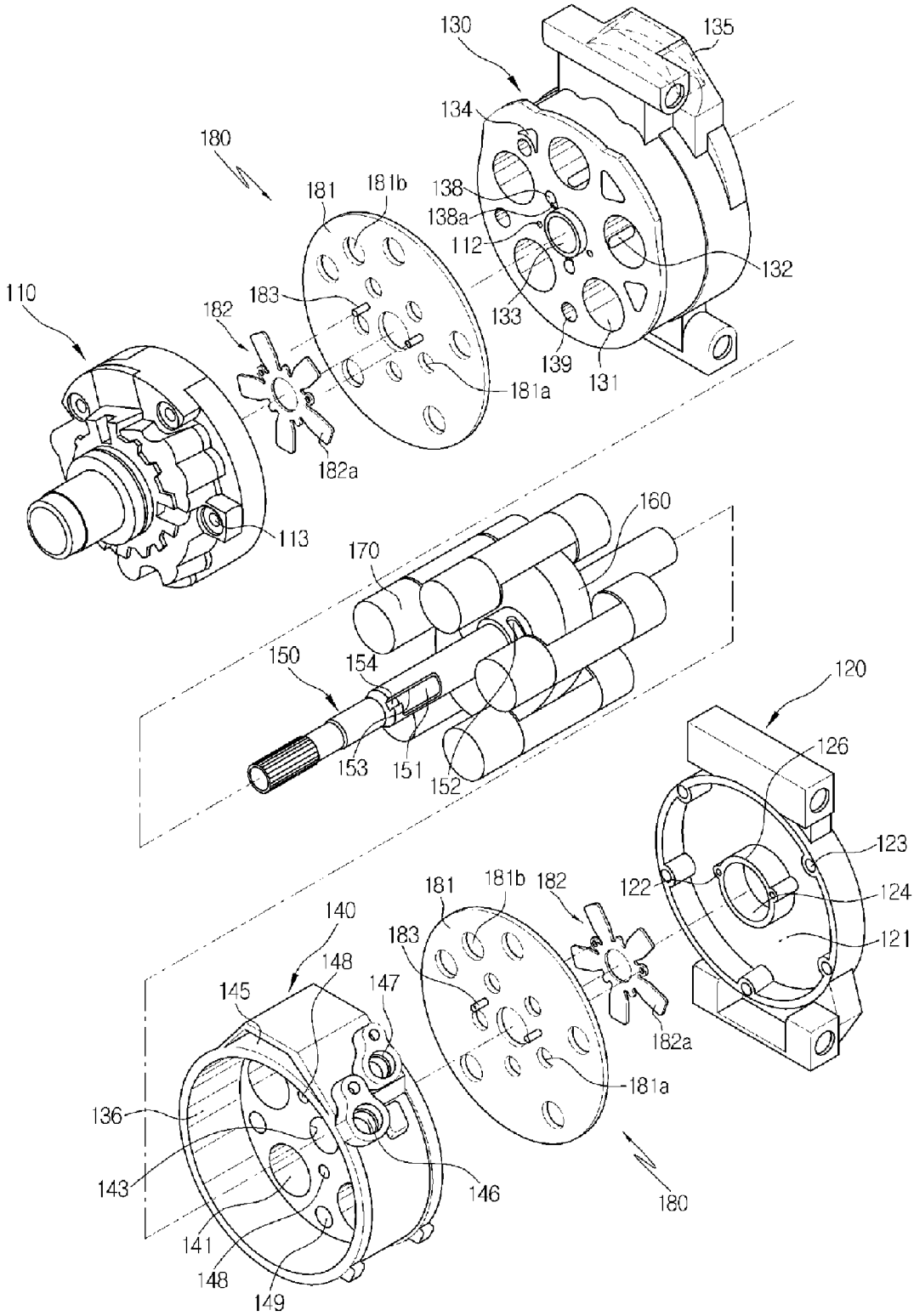

[Fig. 5]
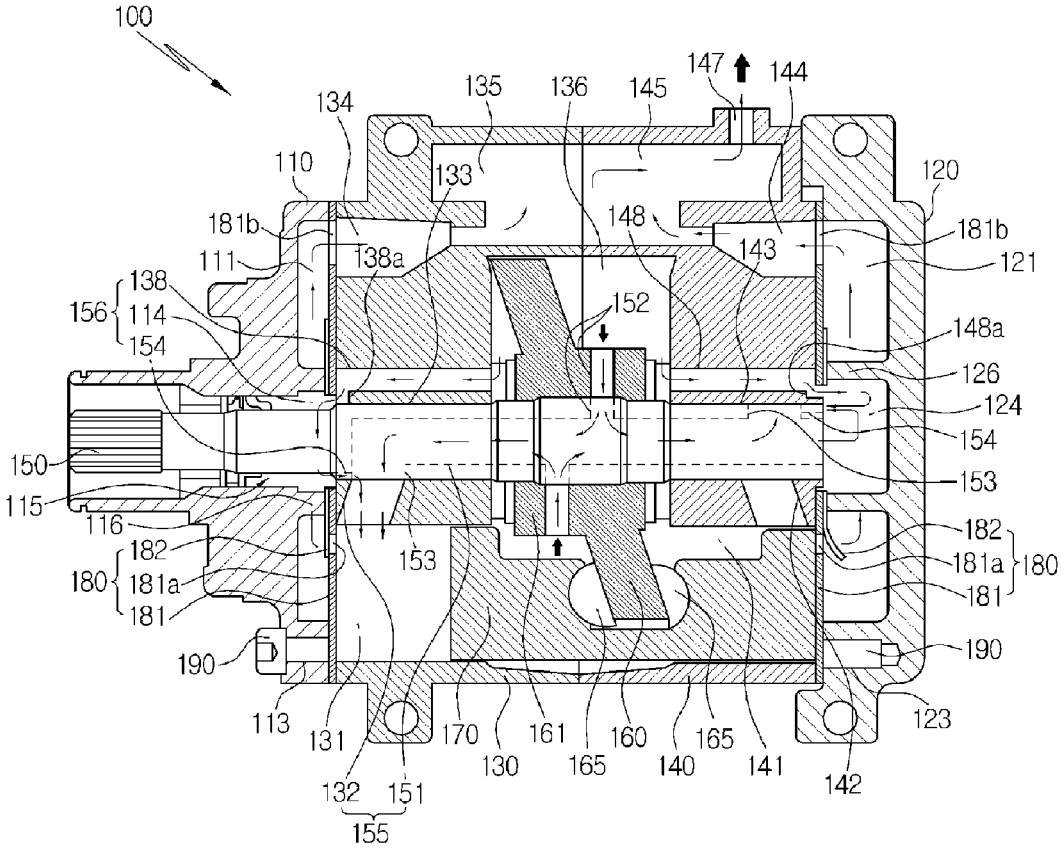
[Fig. 6]
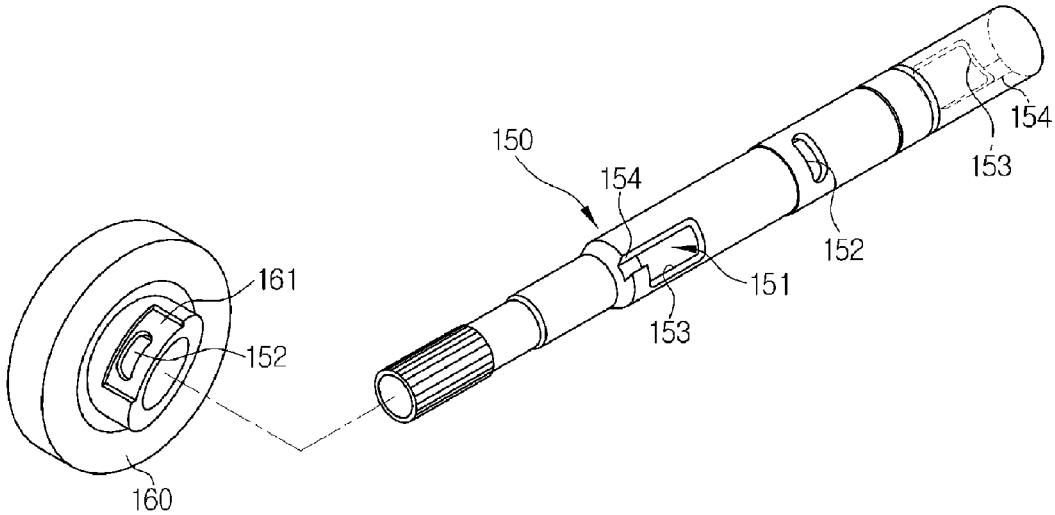

[Fig. 7]
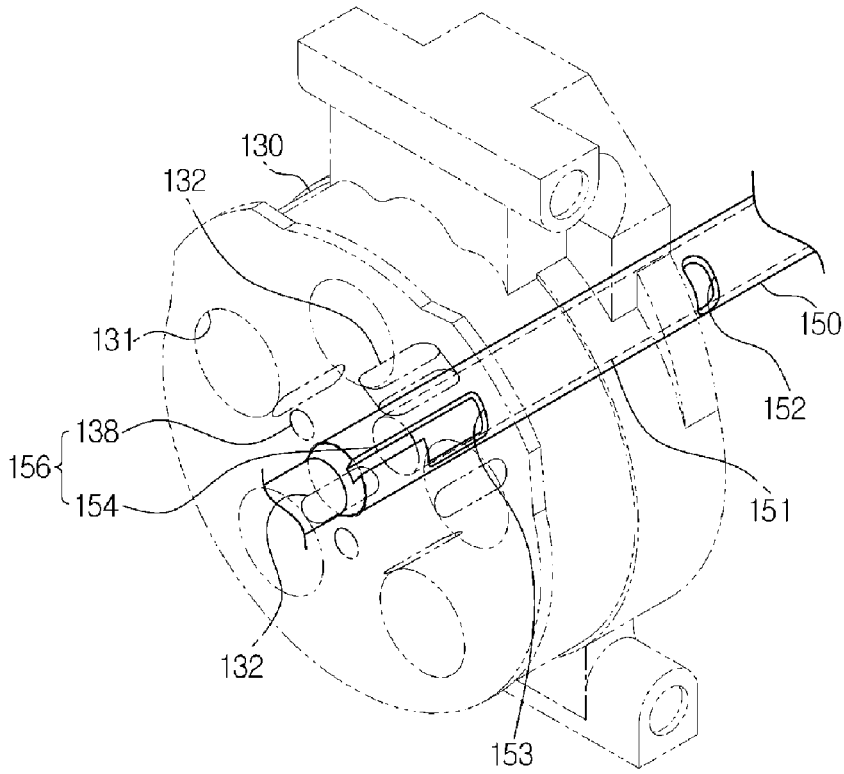
[Fig. 8]
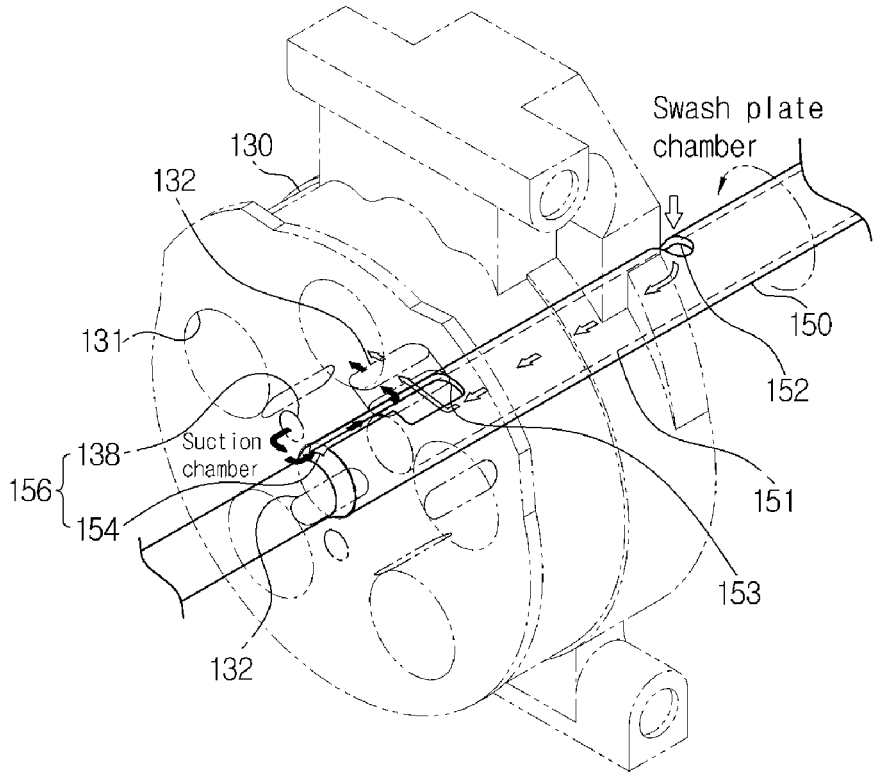

[Fig. 9]
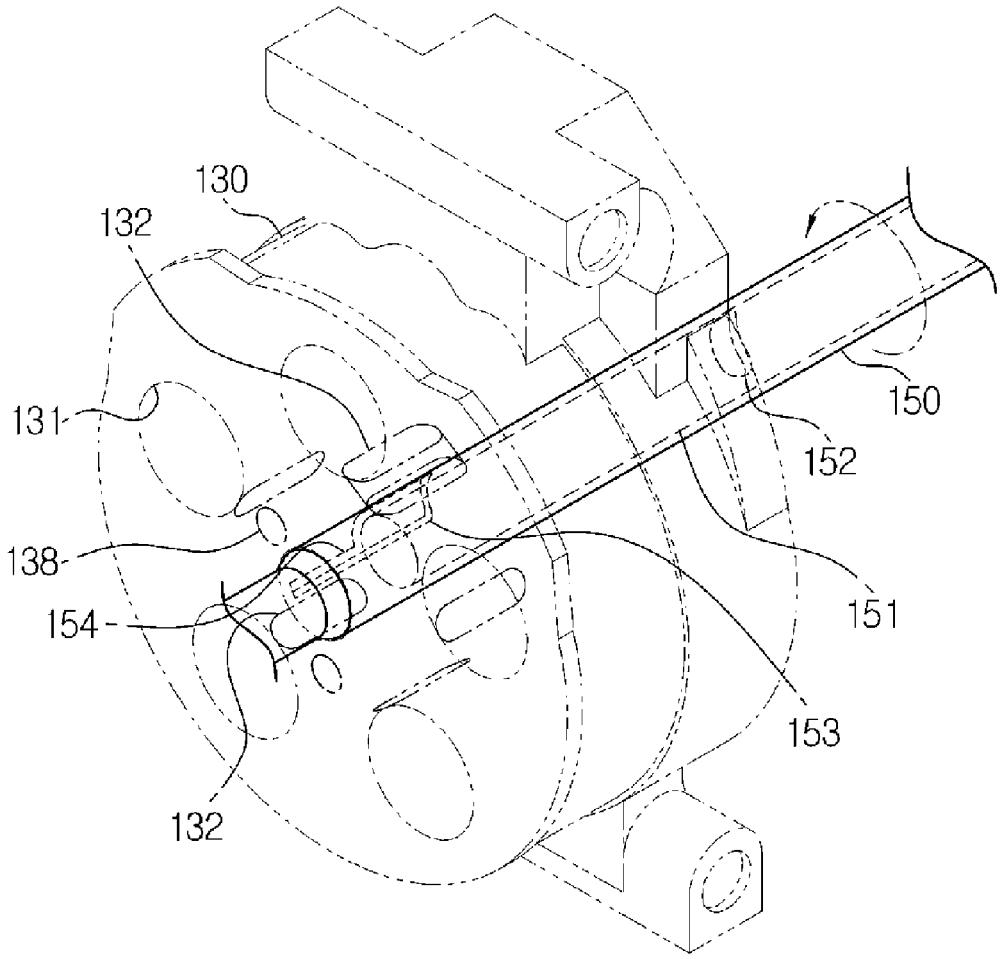

COMPRESSOR

This application is a §371 of PCT/KR2006/003142 filed Aug. 11, 2006, which claims priority from Korean Patent Application No. 10-2005-0129708 filed Dec. 26, 2005.

TECHNICAL FIELD

The present invention relates to a compressor, and more particularly, to a compressor, which includes a main refrigerant supply channel for supplying refrigerant by passing through the inside of a driving shaft and an auxiliary refrigerant supply channel for supplying refrigerant by passing through a suction chamber of front and rear housings and a slot of the driving shaft after passing through cylinder blocks in order to supply the refrigerant inhaled into a swash plate chamber to cylinder bores, thereby enhancing performance and lubricating ability of a driving shaft seal area since the refrigerant of the swash plate chamber can be used effectively.

BACKGROUND ART

In general, a compressor for an automobile inhales refrigerant discharged after the refrigerant evaporated in an evaporator, converts it into liquescent refrigerant gas of high-temperature and high-pressure, and then, discharges it to a condenser.

There are compressors of various kinds, for example, a swash plate type compressor that pistons perform a reciprocating motion by rotation of an inclined swash plate, a scroll type compressor performing compression by rotation of two scrolls, a vane rotary type compressor performing compression by a rotary vane, and so on.

Out of the above compressors, the reciprocating type compressor compressing refrigerant according to the reciprocating motion of the piston is classified into the swash plate type, a crank type, and a wobble plate type, and the swash plate type compressor is also classified into a fixed capacity type and a variable capacity type according to a use purpose.

FIGS. 1 and 2 are views showing a prior art fixed capacity swash plate type compressor. Referring to the drawings, the fixed capacity swash plate type compressor will be described in brief as follows.

As shown in the drawings, the swash plate type compressor 1 includes a front housing 10 having a front cylinder block 20 therein, and a rear housing 10*a* coupled with the front housing 10 and having a rear cylinder block 20*a* therein.

Each of the front and rear housings 10 and 10*a* has a discharge chamber 12 and a suction chamber 11 formed inside and outside a partition 13 in correspondence with a refrigerant discharge hole and a refrigerant suction hole of a valve plate 61, which will be described later.

Here, the discharge chamber 12 includes: a first discharge chamber 12*a* formed inside the partition 13; and a second discharge chamber 12*b* formed outside the partition 13, divided from the suction chamber 11, and fluidically communicated with the first discharge chamber 12*a* through a discharge hole 12*c*.

That is, refrigerant of the first discharge chamber 12*a* is contracted when it passes through the discharge hole 12*c* of a small diameter but expanded when it flows to the second discharge chamber 12*b*. In this instance, pulsating pressure drops to reduce vibration and noise during the contraction and expansion of the refrigerant.

Meanwhile, a plurality of bolt coupling holes 16 are formed on the suction chamber 11 in a circumferential direction. The front and rear housings 10 and 10*a* are coupled and fixed with each other through the bolt coupling holes 16 via bolts 80 in a state where a plurality of components are assembled inside the front and rear housings 10 and 10*a*.

After that, the front and rear cylinder blocks 20 and 20*a* respectively have a plurality of cylinder bores 21 therein, and pistons 50 are combined to the corresponding cylinder bores 21 of the front and rear cylinder blocks 20 and 20*a* in such a way that the pistons 50 perform a straight reciprocating motion. In this instance, the pistons 50 are connected to a driving shaft 30 by interposing a shoe 45 on the outer periphery of a swash plate 40 inclinedly mounted to the driving shaft 30.

So, the pistons 50 reciprocate inside the cylinder bores 21 of the front and rear cylinder blocks 20 and 20*a* while cooperating with the swash plate 40 rotating with the driving shaft 30.

Moreover, valve units 60 are respectively mounted between the front and rear housings 10 and 10*a* and the front and rear cylinder blocks 20 and 20*a*.

Here, the valve unit 60 includes a valve plate 61 having a refrigerant suction hole and a refrigerant discharge hole, and a suction reed valve 63 and a discharge reed valve 63, which are mounted on both sides of the valve plate 61.

The valve units 60 are respectively assembled between the front and rear housings 10 and 10*a* and the front and rear cylinder blocks 20 and 20*a*, and in this instance, the position of the valve unit 60 is fixed while fixing pins 65 formed at both sides of the valve plate 61 are inserted into fixing holes 15 formed on the surfaces of the front housing 10 and the front cylinder block 20 and on the surfaces of the rear housing 10*a* and the rear cylinder block 20*a*.

Meanwhile, the front and rear cylinder blocks 20 and 20*a* have a plurality of suction passageways 22 therein, so that the refrigerant supplied to a swash plate chamber 24 disposed between the front and rear cylinder blocks 20 and 20*a* is flown to each suction chamber 11, and second discharge chambers 12*b* of the front and rear housings 10 and 10*a* are fluidically communicated with each other by connection passageways 23 formed through the front and rear cylinder blocks 20 and 20*a*.

Therefore, suction and compression of the refrigerant can be performed simultaneously inside the bores 21 of the front and rear cylinder blocks 20 and 20*a* according to the reciprocating motion of the pistons 50.

Each of the front and rear cylinder blocks 20 and 20*a* has a shaft support hole 25 formed at the center thereof to support the driving shaft 30, and a needle roller bearing 26 interposed inside the shaft support hole 25 to rotatably support the driving shaft 30.

Meanwhile, The rear housing 10*a* includes a muffler 70 formed on the upper portion of the outer periphery thereof to supply the refrigerant transmitted from an evaporator to the inside of the compressor 1 during a suction stroke of the piston 50, and to discharge the refrigerant compressed in the compressor 1 toward a condenser during a compression stroke of the piston 50.

Hereinafter, a refrigerant circulating process of the compressor 1 having the above structure will be described.

The refrigerant supplied from the evaporator is supplied to the swash plate chamber 24 between the front and rear cylinder blocks 20 and 20*a* through a refrigerant suction hole 71 after the refrigerant is inhaled to a suction part of the muffler 70, and then, flown to the suction chambers 11 of the front and rear housings 10 and 10*a* along the suction passageways 22 formed in the front and rear cylinder blocks 20 and 20*a*.

After that, the suction reed valve 63 is opened during the suction stroke of the piston 50, and in this instance, the refrigerant contained inside the suction chamber 11 is inhaled into the cylinder bore 21 through the refrigerant suction hole of the valve plate.

After that, the refrigerant of the cylinder bore 21 is compressed during the compression stroke of the piston 50, and in this instance, the discharge reed valve 62 is opened, and the refrigerant is flown to the front discharge chambers 12*a* of the front and rear housings 10 and 10*a* through the refrigerant discharge hole of the valve plate.

Continuously, the refrigerant flown to the first discharge chambers 12*a* is discharged to a discharge part of the muffler 70 through a refrigerant discharge hole 72 of the muffler 70 after passing the second discharge chambers 12*b*, and then, flows to the condenser.

Meanwhile, the refrigerant compressed in the cylinder bore 21 of the front cylinder block 20 is discharged to the first discharge chamber 12*a* of the front housing 10, flows to the second discharge chamber 12*b* of the rear housing 10*a* along the connection passageways 23 formed in the front and rear cylinder blocks 20 and 20*a* after flowing to the second discharge chamber 12*b* of the front cylinder block 20, and then, discharged to the discharge part of the muffler 70 through the refrigerant discharge hole 72 together with refrigerant of the second discharge chamber 12*b* of the rear housing 10*a*.

However, the prior art compressor 1 has a disadvantage in that suction volumetric efficiency of refrigerant is decreased due to a loss caused by suction resistance generated by complicated refrigerant flow channels and a loss caused by elastic resistance of the suction reed valve 63 generated during opening and closing of the valve unit 60.

Meanwhile, Korean Patent Laid-open publication No. 2003-47729 discloses a lubricating structure in a fixed capacity piston type compressor, which is a technology to reduce a loss caused by elastic resistance of the suction reed valve 63. That is, the above technology adopts a suction rotary valve integrated with a driving shaft without the suction reed valve, so that refrigerant directly flows from the rear portion of the driving shaft into a cylinder bore through the driving shaft to reduce the loss caused by suction resistance.

However, the prior art has a disadvantage in that the compressor cannot show the optimal compression performance, since refrigerant is inhaled from the rear portion of the driving shaft, and so, a great deal of refrigerant flows into the rear cylinder bore and refrigerant of a small quantity flows into the front cylinder bore.

In addition, the prior art has another disadvantage in that there is a restriction in design, for example, a refrigerant suction part must be formed on the rear portion of the driving shaft.

Moreover, the prior art has another disadvantage in that it is difficult to supply refrigerant of a sufficient amount to the cylinder bores since there is a restriction in enlarging a size of the flow channel formed inside the driving shaft.

DISCLOSURE OF INVENTION

Technical Problem

Accordingly, the present invention has been made to solve the above-mentioned problems occurring in the prior art, and it is an object of the present invention to provide a compressor, which includes a main refrigerant supply channel for supplying refrigerant by passing through the inside of a driving shaft and an auxiliary refrigerant supply channel for supplying refrigerant by passing through a suction chamber of front and rear housings and a slot of the driving shaft after passing through cylinder blocks in order to supply the refrigerant inhaled into a swash plate chamber to cylinder bores, thereby enhancing performance and lubricating ability of a driving shaft seal area since the refrigerant of the swash plate chamber can be used effectively.

Technical Solution

To achieve the above objects, according to the present invention, there is provided a compressor, which includes: a driving shaft to which a swash plate rotating in a swash plate chamber inside the compressor is inclinedly combined; front and rear cylinder blocks respectively having shaft support holes to which the driving shaft is rotatably mounted, and a plurality of the cylinder bores formed at both sides of the swash plate chamber; a plurality of pistons mounted on the outer periphery of the swash plate in such a manner as to interpose a shoe between the piston and the swash plate, for performing a reciprocating motion inside the cylinder bores while cooperating with the rotation of the swash plate; front and rear housings coupled with both sides of the front and rear cylinder blocks and respectively having suction chambers and discharge chambers formed therein; valve units interposed between the front and rear cylinder blocks and the front and rear housings; and a main refrigerant supply channel having a flow channel formed inside the driving shaft and suction passageways respectively formed in the front and rear cylinder blocks for fluidically communicating the shaft support holes and the cylinder bores with each other, the flow channel having an inlet located at the swash plate chamber and outlets respectively located at the shaft support holes of the front and rear cylinder blocks, whereby refrigerant inhaled in to the swash plate chamber from the outside can be supplied into the cylinder bores in order during the rotation of the driving shaft, wherein at least one of the front and rear cylinder blocks has communication holes for fluidically communicating the swash plate chamber with the corresponding suction chamber of the suction chambers of the front and rear housings, and the driving shaft has an auxiliary refrigerant supply channel formed by at least one slot for fluidically communicating the suction chambers with the outlets of the flow channel.

BRIEF DESCRIPTION OF THE DRAWINGS

FIG. 1 is a sectional view of a prior art compressor.

FIG. 2 is a sectional view taken along the line of A-A of FIG. 1.

FIG. 3 is a perspective view of a compressor according to the present invention.

FIG. 4 is an exploded perspective view of the compressor according to the present invention.

FIG. 5 is a sectional view of the compressor according to the present invention.

FIG. 6 is a perspective view showing a state where a driving shaft and a swash plate are disassembled from the compressor according to the present invention.

FIGS. 7 to 9 are brief perspective views showing a process that refrigerant of a swash plate chamber is supplied to cylinder bores according to rotation of the driving shaft.

MODE FOR THE INVENTION

Reference will now be made in detail to the preferred embodiments of the present invention, examples of which are illustrated in the accompanying drawings.

In the present invention, description of the same parts and actions as the prior arts will be omitted.

FIG. 3 is a perspective view of a compressor according to the present invention, FIG. 4 is an exploded perspective view of the compressor according to the present invention.

FIG. 5 is a sectional view of the compressor according to the present invention, FIG. 6 is a perspective view showing a state where a driving shaft and a swash plate are disassembled from the compressor according to the present invention, and FIGS. 7 to 9 are brief perspective views showing a process that refrigerant of a swash plate chamber is supplied to cylinder bores according to rotation of the driving shaft.

As shown in the drawings, the compressor 100 according to the present invention includes: a driving shaft 150 to which a swash plate 160 rotating in a swash plate chamber 136 inside the compressor 100 is inclinedly combined; front and rear cylinder blocks 130 and 140 respectively having shaft support holes 133 and 143 to which the driving shaft 150 is rotatably mounted; a plurality of pistons 170 mounted on the outer periphery of the swash plate 150 in such a manner as to interpose a shoe 165 between the piston and the swash plate, for performing a reciprocating motion inside the cylinder bores 131, 141 while cooperating with the rotation of the swash plate 160; front and rear housings 110 and 120 coupled with both sides of the front and rear cylinder blocks 130 and 140 and respectively having suction chambers 114 and 124 and discharge chambers 111 and 121 formed therein; and valve units 180 interposed between the front and rear cylinder blocks 130 and 140 and the front and rear housings 110 and 120.

First, both ends of the driving shaft 150 are rotatably mounted in the shaft support holes 133 and 143 formed at the centers of the front and rear cylinder blocks 130 and 140, and in this instance, an end of the driving shaft 150 extends to pass through the front housing 110 and is connected with an electronic clutch (not shown).

Moreover, the front and rear cylinder blocks 130 and 140 respectively have a plurality of cylinder bores 131 and 141 axially formed at both sides of the swash plate chamber 136 formed inside the cylinder blocks 130 and 140, and shaft support holes 133 and 143 formed at the centers thereof for rotatably supporting the driving shaft 150.

Furthermore, the front and rear housings 110 and 120 respectively have partitions 116 and 126 interposed between the suction chambers 114 and 124 and the discharged chambers 111 and 121, and in this instance, the suction chambers 114 and 124 are formed inside the partitions 116 and 126 but the discharge chambers 111 and 121 are formed outside the partitions 116 and 126. In this instance, a driving shaft seal area 115 is formed between the front housing 110 and the driving shaft 150, and a sealing member is mounted in the driving shaft seal area 115 for tightly sealing the housing 110 so that the refrigerant does not leak out between the front housing 110 and the driving shaft 150.

Here, it is preferable that the suction chamber 114 of the front housing 110 is partitioned by the sealing member of the driving shaft 150 and formed in a driving shaft inserting space where the driving shaft 150 is rotatably mounted, but the suction chamber 114 may be separately formed in the front housing 110 or the driving shaft inserting space of the front housing 110 may be utilized as the suction chamber 114.

Furthermore, on the outer periphery of one of the front and rear cylinder blocks 130 and 140, formed are a suction port 146 fluidically communicated with the swash plate chamber 136 for supplying the outside refrigerant to the swash plate chamber 136, and a discharge port 147 fluidically communicated with the discharge chambers 111 and 121 for discharging the refrigerant contained inside the discharge chambers 111 and 121 of the front and rear housings 110 and 120 to the outside.

Therefore, the front and rear cylinder blocks 130 and 140 respectively have discharge passageways 134 and 144 for connecting the discharge chambers 111 and 121 of the front and rear housings 110 and 120 with the discharge port 147, and in this instance, mufflers 135 and 145 are respectively formed on the outer peripheries of the cylinder blocks 130 and 140 by expanding the discharge passageways 134 and 144 to reduce noise by decreasing pulsating pressure of the discharged refrigerant.

In addition, the valve unit 180 includes a valve plate 181 having a plurality of refrigerant discharge holes 181*a* for fluidically communicating the cylinder bores 131 and 141 with the discharge chambers 111 and 121 of the front and rear housings 110 and 120, and a discharge reed valve 182 mounted at a side of the valve plate 181 for opening and closing the refrigerant discharge holes 181*a*.

That is, the discharge reed valve 182 has reeds 182*a* mounted to direct the discharge chambers 111 and 121 of the front and rear housings 110 and 120 from the valve plate 181, and elastically transformed to open the refrigerant discharge holes 181*a* during the compression stroke of the pistons 170 and close the refrigerant discharge holes 181*a* during the suction stroke.

Furthermore, the valve plate 181 has communication passageways 181*b* for fluidically communicating the discharge chambers 111 and 121 with the discharge passageways 134 and 144, so that the refrigerant contained inside the discharge chambers 111 and 121 of the front and rear housings 110 and 120 is discharged to the discharge port 147 through the discharge passageways 134 and 144 of the front and rear cylinder blocks 130 and 140.

Additionally, the valve unit 180 has fixing pins 183 mounted at both sides of the valve plate 181 and inserted into fixing holes 112 formed on the surfaces of the front housing 110 and the front cylinder block 130 and on the surfaces of the rear housing 120 and the rear cylinder block 140, whereby the valve unit 180 is connected and fixed to the front and rear housings 110 and 120 and the front and rear cylinder blocks 130 and 140.

Meanwhile, the front and rear housings 110 and 120 and the front and rear cylinder blocks 130 and 140 respectively have a plurality of bolt coupling holes 113, 123, 139 and 149 formed on the rims of the inner peripheries thereof, so that the front and rear housings 110 and 120 and the front and rear cylinder blocks 130 and 140 are coupled and fixed to each other through the bolt coupling holes 113, 123, 139 and 149 via bolts 190 in a state where they are assembled with other components.

In addition, the present invention has two refrigerant supply channels 155 and 156 for supplying the refrigerant, which is inhaled from the outside (evaporator) to the swash plate chamber 136, into the cylinder bores 131 and 141 in order during the rotation of the driving shaft 150, namely, the main refrigerant supply channel 155 and the auxiliary refrigerant supply channel 156.

The main refrigerant supply channel 155 includes: a flow channel 151 axially formed inside the driving shaft 150 and having an inlet 152 located at the swash plate chamber 136 and outlets 153 respectively located at the shaft support holes 133 and 143 of the front and rear cylinder blocks 130 and 140; and a plurality of suction passageways 132 and 142 formed in the front and rear cylinder blocks 130 and 140 for fluidically communicating the shaft support holes 133 and 143 with the cylinder bores 131 and 141, whereby the outlets 153 of the flow channel 151 can be fluidically communicated with the cylinder bores 131 and 141 in order during the rotation of the driving shaft 150.

In this instance, the flow channel 151 is formed by axially processing the inside of the driving shaft 150, and by the processing method of the flow channel 151, the rear housing side of the flow channel 151 is opened.

The inlet 152 of the flow channel 151 is fluidically communicated with the swash plate chamber 136, and the outlets 153 are fluidically communicated with the suction passageways 132 and 142 of the front and rear cylinder blocks 130 and 140.

Here, the inlet 152 of the flow channel 151 is formed by perforating a side of a hub 161 of the swash plate 160 and a side of the driving shaft 150.

Meanwhile, just one inlet 152 of the flow channel 151 may be formed at a side of the driving shaft 150, or two inlets 152 may be formed in the opposite directions. Of course, two or more inlets 152 may be formed.

Additionally, the outlets 153 of the flow channel 151 are formed at both sides of the flow channel 151 in the opposite directions, so that the refrigerant can be simultaneously supplied into the cylinder bores 131 and 141 disposed at both sides of the swash plate chamber 136 during the rotation of the driving shaft 150.

That is, since the swash plate 160 is formed inclinedly, the pistons 170, which are mounted on the outer periphery of the swash plate 160 and arranged in the opposite directions, perform the same suction or compression stroke, the outlets 153 of the flow channel 151 must be formed oppositely, so that the refrigerant can be simultaneously supplied to the cylinder bores 131 and 141 disposed at both sides of the swash plate 136.

Of course, the directions of the outlets 153 of the flow channel 151 formed in the driving shaft 150 can be changed according to the number or a design target of the pistons 170.

The auxiliary refrigerant supply channel 156 supplies the refrigerant of the swash plate chamber 136 after passing through the front and rear cylinder blocks 130 and 140 and passing through the suction chambers 114 and 124 of the front and rear housings 110 and 120 and slots 1154 of the driving shaft 150. In this instance, the auxiliary refrigerant supply channel 156 may be formed in front of and/or behind the swash plate chamber 136.

That is, the auxiliary refrigerant supply channel 156 has a communication hole 138 formed in at least one of the front and rear cylinder blocks 130 and 140 for fluidically communicating the swash plate chamber 136 with the corresponding suction chamber of the suction chambers 114 and 124 of the front and rear housings 110 and 120, and the driving shaft 150 has at least one slot 154 for fluidically communicating the outlets 153 of the flow channel 151 with the suction chambers 114 and 124.

The slot 154 is axially formed at a side of the outlet 153 of the flow channel 151, and in this instance, it is preferable that the slot 154 is lopsidedly formed at a side of the outlet 153 starting to be fluidically communicated with the suction passageways 132 and 142 during the rotation of the driving shaft 150. Therefore, during the rotation of the driving shaft 150, the refrigerant contained inside the suction chambers 114 and 124 can be sufficiently supplied through the slot 154 from the time when the outlets 153 of the flow channel 151 start to be fluidically communicated with the suction passageways 132 and 142 and till the time when the communication between the outlets 153 and the suction passageways 132 and 142 is released.

In addition, a plurality of the slots 154 for fluidically communicating the suction chambers 114 and 124 with the outlets 153 of the flow channel 151 can be formed on the driving shaft axially or circumferentially or in various shapes.

Furthermore, the respective cylinder blocks 130 and 140 further include communication paths 138*a* and 148*a* formed at a side of each cylinder block, in which each of the communication holes 138 and 148 is formed, for fluidically communicating each of the communication holes 138 and 148 with the corresponding suction chamber of the suction chambers 114 and 124.

That is, when the valve units 180 are respectively interposed between the front and rear cylinder blocks 130 and 140 and the front and rear housings 110 and 120, since there is a possibility that the inner diameter portion of the valve plate 181 may close the communication holes 138 and 148 formed in the front and rear cylinder blocks 130 and 140, the communication holes 138 and 148 can be fluidically communicated with the suction chambers 114 and 124 of the front and rear housings 110 and 120 without interference of the valve plate 181 by forming the communication paths 138*a* and 148*a*.

Alternatively, the communication holes 138 and 148 may be inclinedly formed in the cylinder blocks 130 and 140 to avoid the interference of the valve plate 181 without forming the communication paths 138*a* and 148*a*, whereby the swash plate chamber 136 can be fluidically communicated with the suction chambers 114 and 124.

As described above, in the present invention, the two flow channels respectively having the main refrigerant supply channel 155 and the auxiliary refrigerant supply channel 156 are fluidically communicated with the suction passageways 132 and 142 of the front and rear cylinder blocks 130 and 140 in an independent state. That is, the outlets of the main refrigerant supply channel 155 and the auxiliary refrigerant supply channel 156 are formed and fluidically communicated with inlets of the suction passageways 132 and 142.

In the compressor 100 according to the present invention, when the driving shaft 150, which selectively receives driving power from the electronic clutch (not shown), is rotated, the swash plate 160 is rotated, and in this instance, a plurality of the pistons 170 cooperating with the rotation of the swash plate 160 repeatedly perform refrigerant inhaling and compressing actions while reciprocating inside the cylinder bores 131 and 141 of the front and rear cylinder blocks 130 and 140.

That is, during the suction stroke of the pistons 170, the outside refrigerant is inhaled into the swash plate chamber 136 through the suction port 146, and then, directly supplied to the cylinder bores 131 and 141 through the flow channel 151 of the driving shaft 150, and at the same time, supplied to the cylinder bores 131 and 141 also through the communication holes 138 and 148 of the front and rear cylinder blocks 130 and 140, the suction chambers 114 and 124 of the front and rear housings 110 and 120, and the slot 154 of the driving shaft 150.

During the compression stroke of the pistons 170, the refrigerant supplied into the cylinder bores 131 and 141 is compressed by the pistons 170, discharged to the discharge chambers 111 and 121 of the front and rear housings 110 and 120, and then, discharged to the discharge port 147 through the discharge passageways 134 and 144 and the mufflers 135 and 145 of the front and rear cylinder blocks 130 and 140.

Hereinafter, the refrigerant circulating process will be described in more detail.

First, the refrigerant circulating process through the main refrigerant supply channel 155 will be described.

The refrigerant inhaled into the swash plate chamber 136 through the suction port 146 is supplied into the cylinder bores 131 and 141 of the front and rear cylinder blocks 130 and 140 in order through the flow channel 151 of the driving shaft 150 during the rotation of the driving shaft 150.

That is, as shown in FIG. 8, when the driving shaft 150 is rotated, the outlets 153 of the flow channel 151 formed in the driving shaft 150 are also rotated, and in this instance, the swash plate chamber 136 is fluidically communicated with the cylinder bores 131 and 141 during the process that the refrigerant passes through the suction passageways 132 and 142 where the outlets 153 are fluidically communicated with the cylinder bores 131 and 141, whereby the refrigerant contained inside the swash plate chamber 136 is supplied into the cylinder bores 131 and 141 through the flow channel 151.

Here, the refrigerant contained in the swash plate chamber 136 is continuously supplied to the cylinder bores 131 and 141 while the outlet 153 of the flow channel 151 is fluidically communicated with the suction passageways 132 and 142.

In this instance, during the process that the refrigerant contained in the swash plate chamber 136 is supplied into the cylinder bores 131 and 141 through the flow channel 151 of the driving shaft 150, as shown in FIG. 9, when the outlet 153 is continuously rotated and completely gets free from the suction passageways 132 and 142 where supply of refrigerant is going on, the communication between the swash plate chamber 136 and the corresponding cylinder bores 131 and 141 is interrupted, whereby the supply of refrigerant toward the corresponding cylinder bores 131 and 141 is interrupted, and then, the pistons 170 perform the compression stroke in the cylinder bores 131 and 141 where the supply of refrigerant is interrupted.

As described above, while the driving shaft 150 is rotated, the cylinder bores 131 and 141 are fluidically communicated with the swash plate chamber 136 in order through the flow channel 151, and so, the refrigerant contained in the swash plate chamber 136 is supplied to the cylinder bores 131 and 141 and the pistons 170 perform the compression stroke inside the cylinder bores 131 and 141, where the supply of refrigerant is finished, in order.

Of course, since the flow channel 151 formed in the driving shaft 150 simultaneously connects and communicates the swash plate chamber 136 with the cylinder bores 131 and 141 respectively formed on the front and rear cylinder blocks 130 and 140, suction and compression actions are simultaneously performed inside each of the cylinder bores 131 and 141 of the front and rear cylinder blocks 130 and 140.

Continuously, during the compression stroke of the pistons 170, the refrigerant contained inside the cylinder bores 131 and 141 is compressed, and in this instance, the reeds 182*a* of the discharge reed valve 182 is elastically transformed and opens the refrigerant discharge hole 181*a* of the valve plate 181, whereby the cylinder bores 131 and 141 and the discharge chambers 111 and 121 of the front and rear housings 110 and 120 are fluidically communicated with each other, so that the refrigerant compressed inside the cylinder bores 131 and 141 is moved to the discharge chambers 111 and 121 of the front and rear housings 110 and 120.

After that, the refrigerant moved to the discharge chambers 111 and 121 of the front and rear housings 110 and 120 is moved into the mufflers 135 and 145 along the discharge passageways 134 and 144 of the front and rear cylinder blocks 110 and 120, and then, discharged through the discharge port 147.

Next, in connection with the refrigerant circulating process through the auxiliary refrigerant supply channel 156, only parts discriminated from the refrigerant circulating process through the main refrigerant supply channel 156 will be described.

The refrigerant inhaled into the swash plate chamber 136 through the suction port 146 is induced into the suction chambers 114 and 124 of the front and rear housings 110 and 120 through the communication holes 138 and 148 of the front and rear cylinder blocks 130 and 140.

In this instance, since the suction chambers 114 and 124 of the front and rear housings 110 and 120 is always fluidically communicated with the outlets 153 of the flow channel 151 through the slot 154 of the driving shaft 150, the refrigerant induced into the suction chambers 114 and 124 is supplied to the cylinder bores 131 and 141 through the slot 154, the outlets 153 and the suction passageways 132 and 142 at the time when the outlets 153 are fluidically communicated with the suction passageways 132 and 142 of the front and rear cylinder blocks 130 and 140 when the driving shaft 150 is rotated. The process progressed after the above is the same as the refrigerant circulating process of the main refrigerant supply channel 155.

Meanwhile, since a rear housing 120 side end of the driving shaft 150 is opened, besides the above refrigerant supplying method through the communication hole 148 of the rear cylinder block 140, the suction chamber 124 and the slot 154, some of the refrigerant induced into the flow channel 151 of the driving shaft 150 in the swash plate chamber 136 is directly supplied to the cylinder bore 141 of the rear cylinder block 140 through the outlet 153, and the rest is moved to the suction chamber 124 of the rear housing 120 in the flow channel 151 of the driving shaft 150 and supplied to the cylinder bore 141 of the rear cylinder block 140 through the slot 154.

As described above, the present invention can simultaneously supply the refrigerant of the swash plate chamber 136 to the cylinder bores 131 and 141 of the front and rear cylinder blocks 130 and 140 through the main refrigerant supply channel 155 and the auxiliary refrigerant supply channel 156, thereby enhancing performance by effectively using the refrigerant contained inside the swash plate chamber 136.

In addition, during the process that the refrigerant of the swash plate chamber 136 passes through the driving shaft seal area 115 of the front housing 110 through the auxiliary refrigerant supply channel 156, oil contained in the refrigerant is supplied to the driving shaft seal area 115, and so, lubricating ability is also enhanced.

As described above, the case where the structure of the driving shaft integrated type suction rotary valve, which has the main refrigerant supply channel 155 and the auxiliary refrigerant supply channel 156 formed inside the compressor 100 for directly supplying the refrigerant of the swash plate chamber 136 to the cylinder bores 131 and 141 of the front and rear cylinder blocks 130 and 140, is described in the present invention, but the present invention is not restricted to the above, and can be applied to compressors of various kinds, such as a variable capacity swash plate type compressor, a motor driven compressor and others, in the same method and structure to obtain the same effects.

INDUSTRIAL APPLICABILITY

As described above, the present invention has the main refrigerant supply channel and the auxiliary refrigerant supply channel for supplying the refrigerant inhaled into the swash plate chamber to the cylinder bores, thereby enhancing performance and improving lubricating ability of the driving shaft seal area by effectively using the refrigerant contained inside the swash plate chamber.

In addition, the present invention can reduce a loss caused by flow channel resistance by simplifying the refrigerant flow channel and a loss caused by elastic resistance by removing the prior art suction reed valve, thereby enhancing suction volumetric efficiency of refrigerant and enhancing compression efficiency by uniformly distributing the refrigerant to each of the cylinder bores formed at both sides of the swash plate chamber.

The invention claimed is:

1. A compressor comprising:

a driving shaft to which a swash plate rotating in a swash plate chamber inside the compressor is inclinedly combined;

front and rear cylinder blocks respectively having shaft support holes to which the driving shaft is rotatably mounted, and a plurality of the cylinder bores formed at both sides of the swash plate chamber;

a plurality of pistons mounted on the outer periphery of the swash plate in such a manner as to interpose a shoe between the piston and the swash plate, for performing a reciprocating motion inside the cylinder bores while cooperating with the rotation of the swash plate;

front and rear housings coupled with both sides of the front and rear cylinder blocks and respectively having suction chambers and discharge chambers formed therein;

valve units interposed between the front and rear cylinder blocks and the front and rear housings; and a main refrigerant supply channel having a flow channel formed inside the driving shaft and suction passageways respectively formed in the front and rear cylinder blocks for fluidically communicating the shaft support holes and the cylinder bores with each other, the flow channel having an inlet located at the swash plate chamber and outlets respectively located at the shaft support holes of the front and rear cylinder blocks, whereby refrigerant inhaled in to the swash plate chamber from the outside can be supplied into the cylinder bores in order during the rotation of the driving shaft, wherein an auxiliary refrigerant supply channel has a communication hole formed in at least one of the front and rear cylinder blocks and for fluidically communicating the swash plate chamber with the corresponding suction chamber of the suction chambers of the front and rear housings, and at least one slot formed in the driving shaft for fluidically communicating the outlets of the flow channel with the suction chambers.

2. The compressor according to claim 1, wherein the inlet of the flow channel is formed by perforating a side of a hub of the swash plate and a side of the driving shaft to be fluidically communicated with the swash plate chamber, and the outlets are fluidically communicated with the suction passageways of the front and rear cylinder blocks.

3. The compressor according to claim 1, wherein the slot is axially formed at a side of the outlet of the flow channel, in such manner as to be lopsidedly formed at the side of the outlet which starts to be fluidically communicated with the suction passageways during the rotation of the driving shaft.

4. The compressor according to claim 1, wherein at a side of cylinder blocks where the communication holes are formed communication paths for fluidically communicating the communication holes with the corresponding one of the suction chambers are also formed.

5. The compressor according to claim 1, wherein the suction chamber of the front housing is partitioned by a sealing member of the driving shaft and is a driving shaft inserting space where the driving shaft is rotatably mounted.

* * * * *